US010653287B2

(12) United States Patent
Chung

(10) Patent No.: US 10,653,287 B2
(45) Date of Patent: May 19, 2020

(54) ROTARY MOP CLEANER

(71) Applicant: HONORS CO., LTD., Ansan-si, Gyeonggi-do (KR)

(72) Inventor: Un Hwa Chung, Incheon (KR)

(73) Assignee: HONORS CO., LTD. (KR)

( * ) Notice: Subject to any disclaimer, the term of this patent is extended or adjusted under 35 U.S.C. 154(b) by 138 days.

(21) Appl. No.: 15/923,156

(22) Filed: Mar. 16, 2018

(65) Prior Publication Data

US 2019/0099052 A1 Apr. 4, 2019

(30) Foreign Application Priority Data

Sep. 29, 2017 (KR) ..... 10-2017-0127192

(51) Int. Cl.

| | |
|---|---|
| ***A47L 13/20*** | (2006.01) |
| ***A47L 11/282*** | (2006.01) |
| ***A47L 11/40*** | (2006.01) |
| ***A47L 11/283*** | (2006.01) |
| ***A47L 11/16*** | (2006.01) |

(52) U.S. Cl.

CPC ..... *A47L 13/20* (2013.01); *A47L 11/16* (2013.01); *A47L 11/282* (2013.01); *A47L 11/283* (2013.01); *A47L 11/4036* (2013.01); *A47L 11/4038* (2013.01); *A47L 11/4069* (2013.01)

(58) Field of Classification Search

CPC ..... A47L 11/16; A47L 11/282; A47L 11/283; A47L 11/4036; A47L 11/4038; A47L 11/4069; A47L 13/20

See application file for complete search history.

(56) References Cited

U.S. PATENT DOCUMENTS

| | | | |
|---|---|---|---|
| 2007/0071540 | A1 | 3/2007 | Jung |
| 2013/0068647 | A1 | 3/2013 | Mishan et al. |
| 2013/0205535 | A1 | 8/2013 | Krebs |

FOREIGN PATENT DOCUMENTS

| | | |
|---|---|---|
| EP | 1913858 A2 | 4/2008 |
| JP | 08-336251 | 12/1996 |
| JP | 2004-188075 | 7/2004 |
| JP | U 3200321 | 9/2015 |
| KR | 20-2010-0003108 | 3/2010 |

(Continued)

OTHER PUBLICATIONS

KR-100956737-B1—English Machine Translation (Year: 2010).*

(Continued)

*Primary Examiner* — Marc Carlson

(74) *Attorney, Agent, or Firm* — Harness, Dickey & Pierce, P.L.C.

(57) ABSTRACT

The present disclosure relates to a rotary mop cleaner. The rotary mop cleaner includes: a ball joint provided at a lower end of a stick and having a pair of engagement projections extending outwards from both side ends thereof; a rotary plate drive unit configured to rotate a rotary plate; a body configured to accommodate a lower hemisphere of the ball joint and having guide grooves configured to allow a pair of engagement projections to be inserted therein in order to ensure the rotation of the ball joint; a ball cover configured to cover an upper hemisphere of the ball joint; and a rotary plate bolted to the rotary shaft of the rotary plate drive unit, which extends to the lower portion of the body, so as to be movable relative thereto with a clearance therebetween.

9 Claims, 11 Drawing Sheets

(56) References Cited

FOREIGN PATENT DOCUMENTS

| | | | | | |
|---|---|---|---|---|---|
| KR | 20100003108 | U | * | 3/2010 | |
| KR | 10-0956737 | B1 | | 5/2010 | |
| KR | 100956737 | B1 | * | 5/2010 | ..... A47L 11/16 |
| KR | 10-2011-0087251 | | | 8/2011 | |
| KR | 20110087251 | A | * | 8/2011 | |
| KR | 10-2012-0103963 | | | 9/2012 | |
| KR | 10-2017-0028760 | | | 3/2017 | |
| KR | 10-1799296 | B1 | | 11/2017 | |
| WO | WO-2016/153243 | A1 | | 9/2016 | |

OTHER PUBLICATIONS

KR-20100003108-U—English Machine Translation (Year: 2010).*
KR-20110087251-A—English Machine Translation (Year: 2011).*
U.S. Appl. No. 29/636,961, filed Feb. 13, 2018, Un Hwa Chung.

* cited by examiner

ROTARY MOP CLEANER

CROSS-REFERENCE TO RELATED APPLICATIONS

This application claims priority from Korean Patent Application No. 10-2017-0127192, filed on Sep. 29, 2017, which is hereby incorporated by reference for all purposes as if fully set forth herein.

BACKGROUND OF THE INVENTION

1. Field of the Invention

The present disclosure relates to a rotary mop cleaner, and more particularly, to a rotary mop cleaner in which a stick is freely rotatable in a body and a rotary plate is mounted to have a clearance in an axial direction.

2. Description of the Prior Art

Generally, when performing indoor cleaning at home, accompanying household labor is unavoidable since, after removing garbage and dust using a broom or a vacuum cleaner, it is necessary to repeat the process of removing the hair or dust remaining on the floor surface with a wet mop or a dry mop.

In order to at least alleviate such inconvenience, a wet mop cleaner (Patent Document 1) capable of performing wiping by rotationally driving a pair of mop rotation brackets using a motor has actively been developed.

In the wet-mop cleaner according to the related art, a main body may be rotatably coupled to a cleaning portion by means of a connecting portion. As the connecting portion, a hinge-type connecting portion is widely used. For example, as illustrated in Patent Document 1, a first connecting bar and a second connecting bar, which is orthogonal to the first connecting bar, are hinged to be rotatable in the leftward and rightward directions, while a rotary bar, which is formed at an end of the second connecting bar, is rotatably inserted into an upper case, thereby providing a structure capable of rotating in the forward and backward directions (see FIG. 7). The hinge-type connecting portion described above has problems in that a metal hinge is inevitably used, in that the durability of the coupling between the rotary bar and the plastic main body is poor, and in that when the cleaner is not used, it is difficult to make a handle portion vertically stand by itself with respect to the main body.

SUMMARY OF THE INVENTION

The present disclosure has been made to solve the problems described above, and provides a rotary mop cleaner which is capable of standing by itself and is greatly improved in the durability of a connecting portion thereof.

According to an aspect of the present disclosure, a rotary mop cleaner includes: a ball joint formed at a lower end of a stick; a body configured to rotatably accommodate the ball joint; a ball cover fastened to the body to cover the ball joint; a rotary plate drive unit accommodated in the body and having a rotary shaft; and a rotary plate coupled to the rotary shaft of the rotary plate drive unit to be rotated. The ball joint includes a locking unit therein, the ball cover includes an engagement groove formed to accommodate an end of a locking pin of the locking unit, and the stick is coupled to the body through the ball joint to be pivotable and tiltable in a rearward direction and in leftward and rightward directions.

In the rotary mop cleaner, the ball cover may include a clearance groove formed to expose a connecting portion between the stick and the ball joint.

In the rotary mop cleaner, the rotary plate drive unit may include a pair of rotary shafts which extend downwards from the opposite ends of thereof, and the rotary plate may be provided in a paire to be respectively coupled to the lower ends of the rotary shafts of the rotary plate drive unit to be rotated in opposite directions.

In the rotary mop cleaner, the ball joint may include a hollow ball, a locking pin insertion hole formed in an upper end of the hollow ball, and a locking unit fixedly coupled into an inner space of the hollow ball. When the stick is in a vertically upright state, an end of the locking pin protrudes from an upper portion of the hollow ball through a locking pin insertion hole so as to be accommodated in the engagement groove formed in an inner side of an upper end of the ball cover.

In the rotary mop cleaner, the body may include a base, which is formed with a ball support configured to rotatably accommodate the hollow ball and a through hole configured to allow the rotary shaft to pass therethrough.

In the rotary mop cleaner, the ball joint may further include a pair of engagement projections extending outwards from the opposite side surfaces of the hollow ball, and the base may further include guide grooves formed to face downwards so as to correspond to the pair of engagement projections.

In the rotary mop cleaner, the ball support may include a concave hemispherical accommodation portion configured to accommodate a lower hemisphere of the hollow ball, a seating surface formed along an upper peripheral edge of the accommodation portion, and a pair of concave guide grooves formed in opposite surfaces of the accommodation portion.

In the rotary mop cleaner, the seating surface may be curved to have a curvature which is equal to a curvature of an outer peripheral surface of the hollow ball.

In the rotary mop cleaner, the pair of engagement projections may be disposed on a longitude line that passes through the locking pin insertion hole in the hollow ball.

In the rotary mop cleaner, a straight line connecting the pair of engagement projections may be arranged to be orthogonal to a straight line connecting a center of the hollow ball and the locking pin insertion hole.

In the rotary mop cleaner, the locking unit may include a locking pin having a spring provided therein, a locking pin fixing portion configured to support a vertical movement of the locking pin, and a locking unit support configured to support the locking pin fixing portion and fastened to the inner space of the hollow ball.

In the rotary mop cleaner, the rotary plate may have a shaft connecting hole formed in a central portion thereof, and the shaft connecting hole may include an upper connecting hole configured to accommodate the rotary shaft having a female thread formed in the lower end thereof and a lower connecting hole disposed coaxially with the upper connecting hole and allowing entry of a bolt therein, and an engagement step disposed along the inner peripheral surface of the shaft connecting hole and partitioning the upper connecting hole and the lower connecting hole from each other while allowing communication therebetween.

In the rotary mop cleaner, the bolt may include a bolt head, a bolt shank, and a male thread, and the engagement step may have a thickness smaller than the length of the bolt shank.

In the rotary mop cleaner, the engagement step may have a hole size larger than a size of a cross section of the bolt body.

In the rotary mop cleaner, the body may further include a dome-shaped portion and a cover having an opening formed behind the dome-shaped portion.

The features and advantages of the present disclosure will become more apparent from the following detailed description made with reference to the accompanying drawings.

The terms and words to be used in the specification and claims shall not be construed to be limited to an ordinary or dictionary meaning, but shall be interpreted in a meaning and concept according to the technical idea of the present disclosure based on a principle that the inventor is able to appropriately define a concept of a term in order to describe his/her disclosure in the best way.

As described above, according to the present disclosure, it is possible to provide a ball joint capable of ensuring reliable pivoting and tilting movements of the stick with respect to the body.

Particularly, the present disclosure provides an advantage in that the stick can be erected in an upright state through the ball joint interposed between the body and the ball cover, and a dislocation phenomenon can be reliably prevented.

As described above, according to the present disclosure, the stick is pivotable and adjustable to various angles, thereby enabling cleaning in a narrow space and improving the ability of the body to advance in a straight line.

According to the present disclosure, it is also possible to provide a structure in which the rotary plate, which is coupled by being bolted to an end of the rotary shaft of the rotary plate drive unit to be movable with a clearance in the axial direction of the rotary shaft, so that the rotary plate can be displaced along a floor surface.

Accordingly, the present disclosure is capable of reducing noise and vibration during cleaning, as well as rotatably driving the rotary mop more stably.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
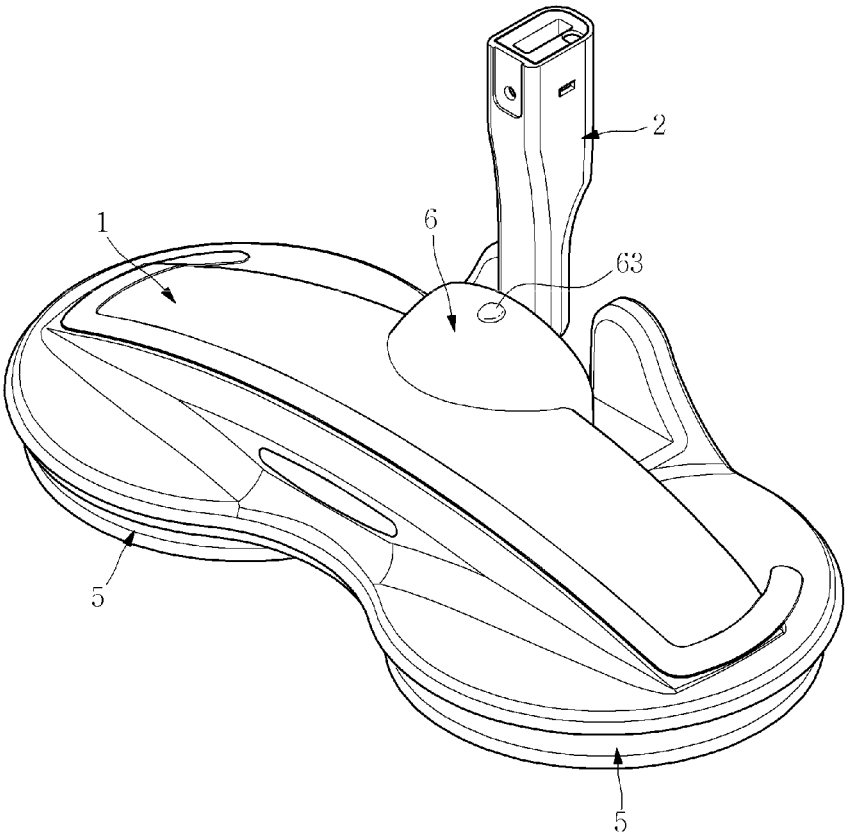
FIG. 1 is a front perspective view of a rotary mop cleaner according to an embodiment of the present disclosure.

The purposes, specific advantages, and novel features of the present disclosure will become more apparent from the following detailed description and examples taken in conjunction with the accompanying drawings. It should be noted that in adding reference numerals to the constituent elements of respective drawings in this specification, the same constituent elements will be denoted by the same numerals if possible, even if the constituent elements are illustrated on different drawings. In the following description of the present disclosure, a detailed description for the related known technology will be omitted when it is determined that the detailed description may make the subject matter of the present disclosure rather unclear. In this specification, the terms such as "first" and "second" are used to distinguish one constituent element from another constituent element, but the constituent elements are not limited by the terms. In the accompanying drawings, some constituent elements are exaggerated, omitted or schematically illustrated, and the size of each constituent element does not accurately reflect the actual size.

Now, a rotary mop cleaner according to an embodiment of the present disclosure will be described in detail with reference to the accompanying drawings.

Figure 2:
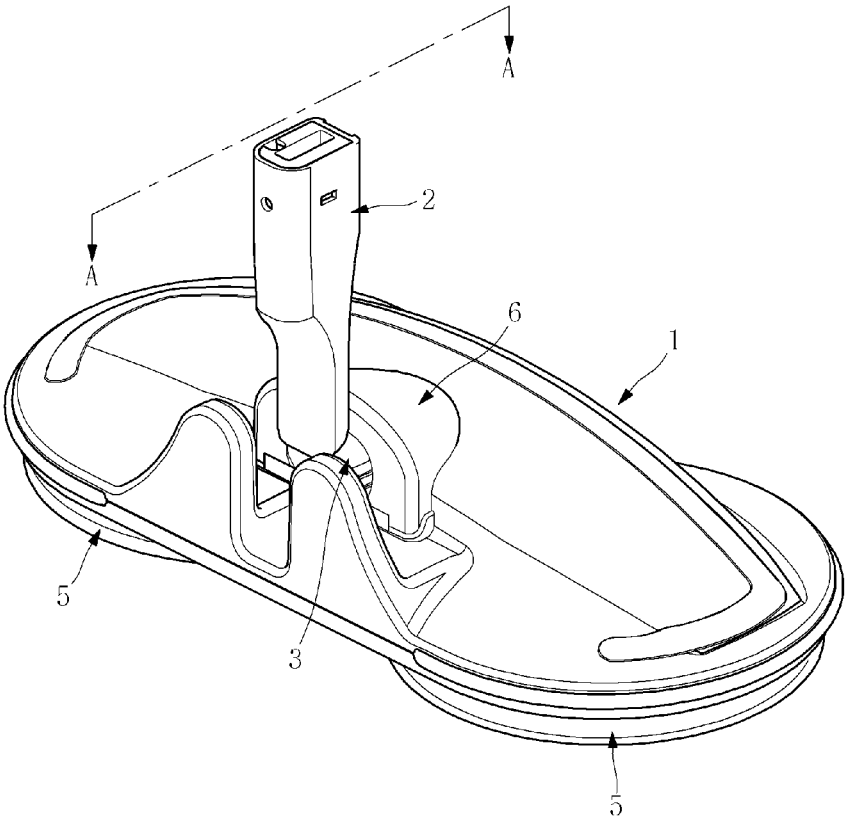
FIG. 2 is a rear perspective view of the rotary mop cleaner according to the embodiment of the present disclosure.
Figure 3:
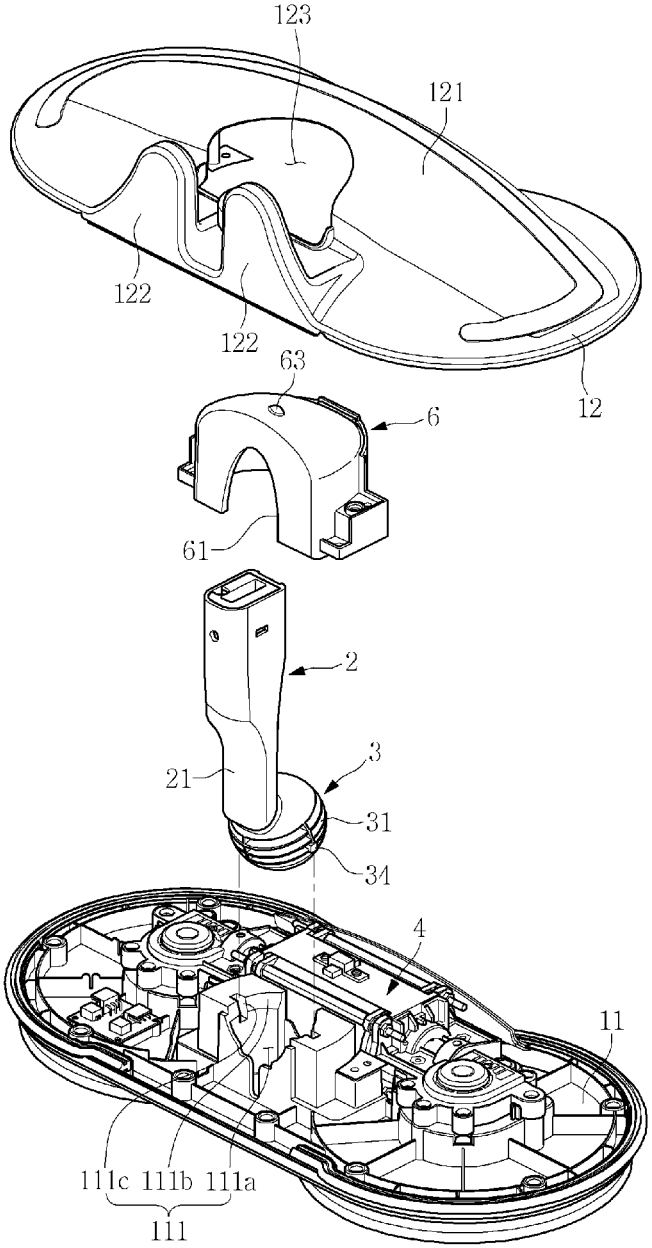
FIG. 3 is an exploded perspective view of the rotary mop cleaner according to the embodiment of the present disclosure, which is illustrated in FIG. 2.

Referring to FIGS. 1 to 3, a rotary mop cleaner according to an embodiment of the present disclosure may include a body 1 having a rotary plate drive unit 4 built therein, a stick 2 coupled to the body 1 to be pivotable and tiltable, and a rotary plate 5 disposed on the bottom surface of the body 1 and coupled to an end of a rotary shaft of the rotary plate drive unit 4.

The rotary mop cleaner according to the embodiment of the present disclosure enables a floor surface to be mopped through rotational driving of at least one rotary plate 5, preferably a pair of rotary plates 5. In order to enable rotational driving of the pair of the rotary plates 5, the rotary plate drive unit 4 having, for example, a worm gear, may be disposed within the body 1 of the rotary mop cleaner. According to the embodiment of the present disclosure, any drive unit may be adopted as long as the drive unit is capable of rotationally driving the pair of rotary plates 5, which will not be described in detail.

As illustrated in the drawings, the body 1 is coupled to the stick 2 in a ball joint manner to be pivotable and tiltable, and at the same time, supports the rotational driving of the pair of rotary plates 5. Specifically, the stick 2 is coupled to the body 1 to be pivotable in the rearward direction and in the leftward and rightward directions, and the inclination angle of the stick is arbitrarily changeable so that ease of use can be improved. As is well known to those skilled in the art, the stick 2 may be provided with a handle (not shown) at the upper end thereof, a power switch may be provided on the handle, and the length of the handle may be adjusted through a length extension portion.

The body 1 may include a base 11 and a cover 12. The base 11 may provide a space that is capable of accommodating therein constituent elements such as the rotary plate drive unit 4 and a ball joint 3 provided at the lower end of the stick 2. As illustrated in the drawings, the pair of rotary plates 5 may be rotatably disposed on the lower surface of the base 11.

In the body 1, the upper portion of the base 11 is covered with the cover 12 so as to accommodate the rotary plate drive unit 4 in an internal space between the base 11 and the cover 12 and to help the seating of the ball joint 3. The body 1 may be coupled such that the cover 12 can be assembled with and/or disassembled from the base 11.

For example, the base 11 helps the positioning of the rotary plate drive unit 4 in the central region thereof, and has through holes 112 (not illustrated), through which respective rotary shafts 41 extend downwards from both ends of the rotary plate drive unit 4. (see FIG. 10). In addition, the base 11 may include a ball support 111 formed in a hemispherical shape so as to rotatably accommodate a hollow ball 31 of the ball joint 3 on the rear side of the rotary plate drive unit 4. As illustrated in the drawing, the ball support 111 is disposed a predetermined distance forwards from the center of the rear edge of the base 11, and accommodates the lower hemisphere of the hollow ball 31 such that separation of the hollow ball 31 can be prevented in advance. Specifically, the ball support 111 may include a recessed hemispherical accommodation portion 111*a*, a seating surface 111*b* formed along the upper peripheral edge surface of the accommodation portion 111*a*, and a pair of guide grooves 111*c* concavely formed in opposite surfaces of the accommodation portion 111*a*. The guide grooves 111*c* may be formed downwards along the inner circumferential surface from the upper edge of the accommodation portion 111*a*, and the pair of guide grooves 111*c* may be connected in a row along the inner circumferential surface of the accommodation portion 111*a*. The accommodation portion 111*a* may have a size and a shape that is capable of sufficiently accommodating the lower hemisphere of the hollow ball 31. The seating surface 111*b* is capable of being in contact with the outer peripheral surface of the hollow ball 31 that rotates in various directions within the accommodation portion so as to support and hold the hollow ball 31. The seating surface 111*b* may be curved to have the same curvature as the outer peripheral surface of the hollow ball 31. According to the embodiment of the present disclosure, in order to ensure smooth rotation of the ball joint 3 in the ball support 111 when the stick 2 is displaced through a pivoting movement and/or a tilting movement, the frictional resistance between the hollow ball 31 and the ball support 111 can be reduced by reducing the contact area therebetween by means of the seating surface 111*b*, and an incidental noise reduction effect can be expected. As illustrated in the drawing, the pair of guide grooves 111*c* may be formed in mutually opposite inner peripheral surfaces of the accommodation portion 111*a* so as to allow the angle of the hollow ball 31 to be adjusted in the leftward or rightward direction, thereby ensuring the tilting movement.

The cover 12 may include a dome-shaped portion 121 protruding upwards in the inner region thereof and a pair of protrusions 122 spaced apart from each other symmetrically with respect to the rear center of the cover 12, and an opening 123 formed behind the dome-shaped portion 121. The opening 123 is formed to have a size and shape that does not impede the pivoting movement and/or the tilting movement of the stick 2, and may be formed at a position corresponding to the ball support 111 of the base 11.

The rotary mop cleaner according to the preferred embodiment of the present disclosure may include a ball cover 6 formed in a size and shape capable of covering the upper hemisphere of the hollow ball 31 of the ball joint 3 while sealing the opening 123 in the cover 12. The ball cover 6 may be fixed on the ball support 111 and may protrude upwards beyond the opening 123 in the cover 12. The ball cover 6 may have a clearance groove 61 in the rear side thereof in order to allow the connecting portion 21 coupled to one side of the ball joint 3 to pass therethrough. The clearance groove 61 may be formed to have a size smaller than the diameter of the hollow ball 31 so as to prevent the hollow ball 31 from escaping therefrom. Particularly, the ball cover 6 may have an engagement groove 63, which is formed in the inner surface of the upper end thereof.

Figure 4:
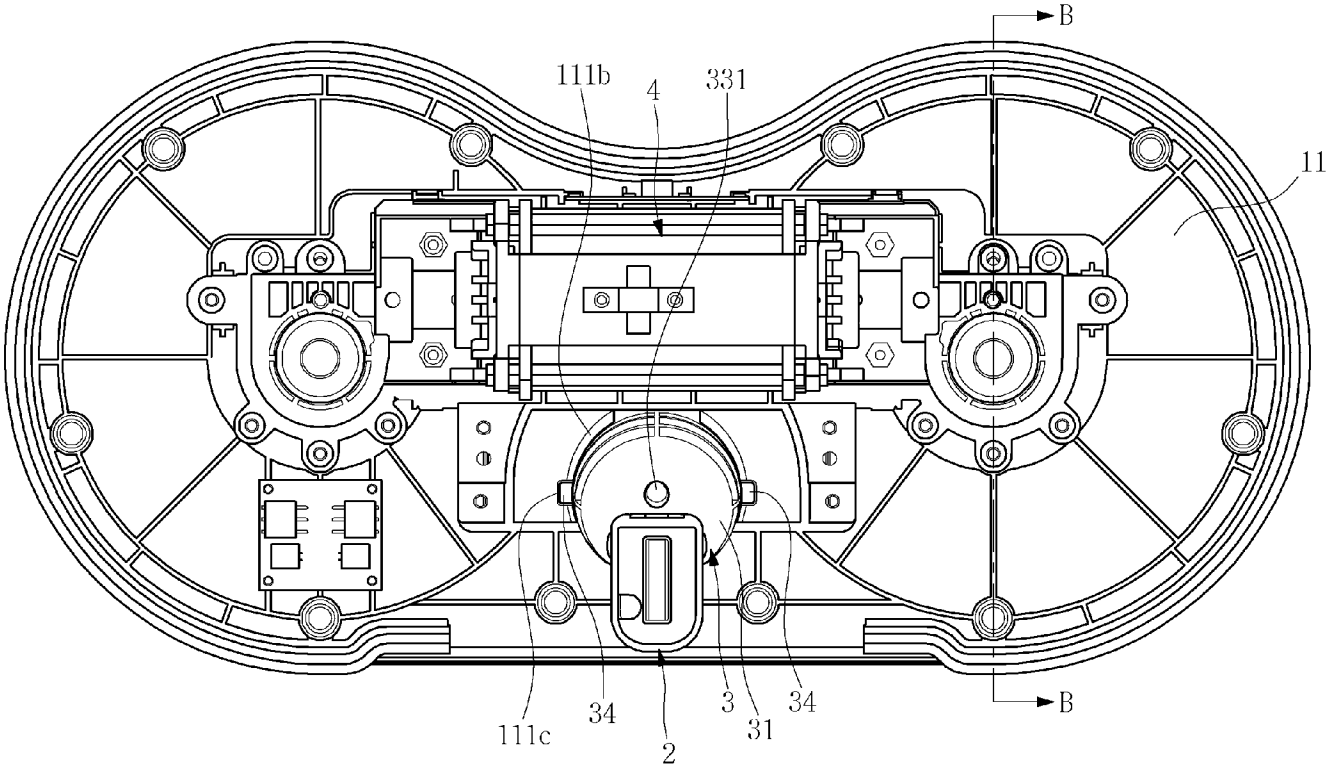
FIG. 4 is a plan view of a rotary mop according to an embodiment of the present disclosure, in which a cover and a ball cover are removed so that the seating state of a ball joint on a base can be confirmed.
Figure 5:
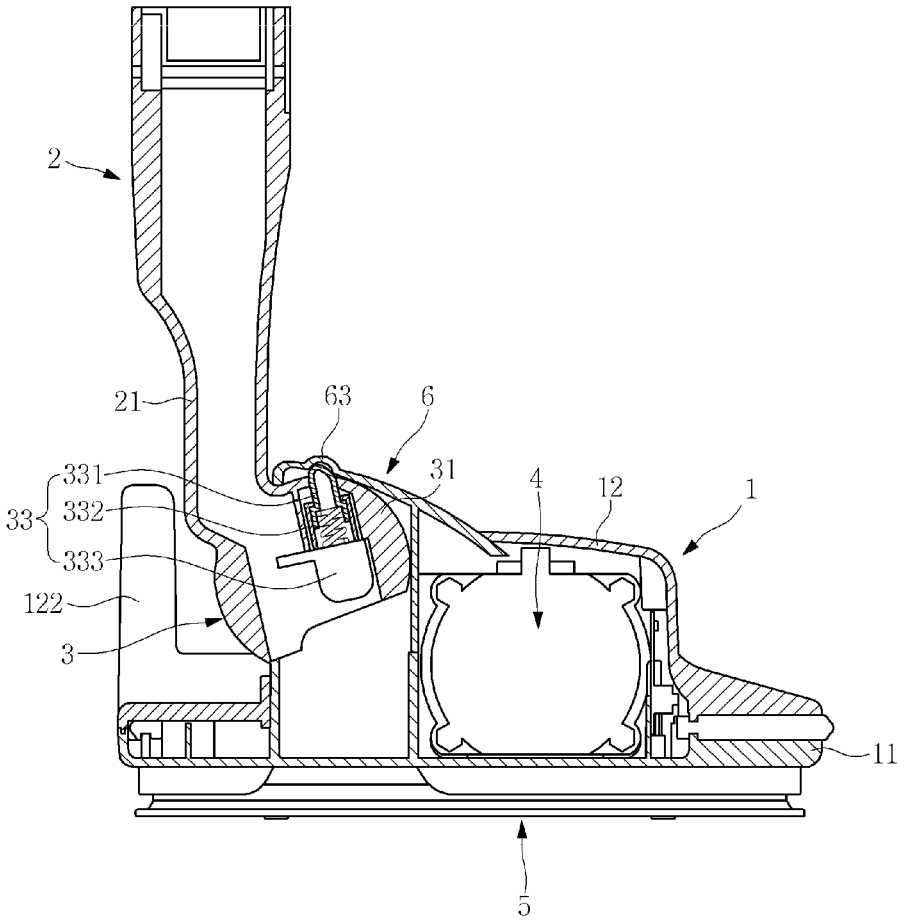
FIG. 5 is a cross-sectional view of the rotary mop cleaner taken along line A-A of FIG. 2.
Figure 6:
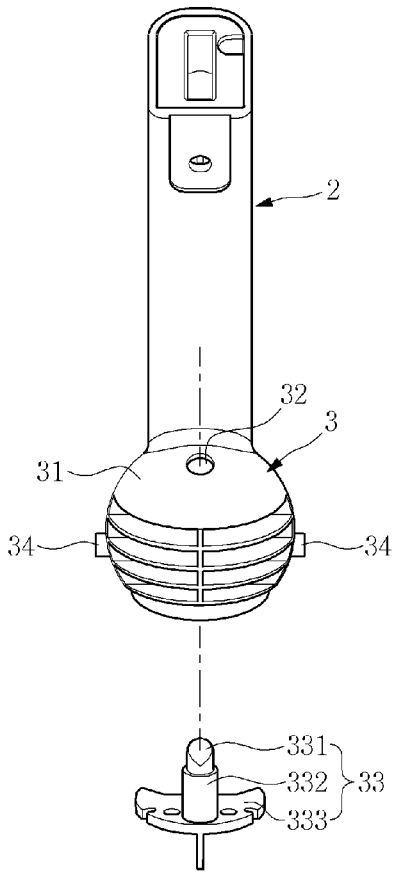
FIG. 6 is an exploded perspective view of the ball joint and a locking unit.

Referring to FIGS. 4 to 6, the rotary mop cleaner according to the embodiment of the present disclosure may include the ball joint 3 for supporting the pivoting movement and/or the tilting movement of the stick 2 in the body 1.

As illustrated in the drawings, the ball joint 3 may be a single element that is coupled through the elongated connecting portion 21 at the lower end of the stick 2 and is integrally connected with the stick 2. The ball joint 3 may include a bottom-opened hollow ball 31 and a locking pin insertion hole 32 formed through the upper end hollow ball 31 so as to communicate with the inner space in the hollow ball 31, a locking unit 33 fixed to the inner space in the hollow ball 31, and a pair of engagement projections 34 extending outwards from both lateral ends of the hollow ball 31. The pair of engagement projections 34 may be disposed on a longitude line that passes through the locking pin insertion hole 32 in the hollow ball 31. For example, a straight line connecting the pair of engagement projections 34 may be arranged to be orthogonal to a straight line connecting the center of the hollow ball 31 and the locking pin insertion hole 32. For example, the locking pin insertion hole 32 may be disposed at the upper end of the hollow ball 31, and the pair of engagement projections 34 may be disposed at two points at which, among virtual horizontal line, which are orthogonal to a virtual vertical line passing through the locking pin insertion hole 32, a horizontal line passing through the center of the hollow ball 31 meets the surface of the hollow ball 31. As illustrated in FIG. 4, when the stick 2 is in an upright state, the pair of engagement projections 34 may be disposed in the pair of guide grooves 111*c* in the ball support 111. Here, the term "upright state" means the state in which the stick stands upright. At this time, the pair of guide grooves 111*c* may be formed in a structure which does not restrict the forward movement of the engagement projections 34 when the stick 2 is pivoted rearwards while restricting the rearward movement of the pair of engagement projections 34 when the stick 2 is in the upright state.

The locking unit 33 may include a locking pin 331 movable in the vertical direction through a spring provided therein, a locking pin fixing portion 332 disposed below the locking pin 331 to support the vertical movement of the locking pin 331, and a locking unit support 333 that supports the locking pin fixing portion 332 and is fastened to the inner space of the hollow ball 31. As described above, the locking unit 33 may be formed such that the locking pin 331 protrudes outwards through the locking pin insertion hole 32 with a spring interposed between the locking pin 331 and the locking pin fixing portion 332. When a pressure is applied to the end of the locking pin 331 from the outside, the locking pin 331 may be retracted to the inside of the locking pin insertion hole 32.

In the rotary mop cleaner according to the embodiment of the present disclosure, the stick 2 may be maintained in the upright state with respect to the body 1 through the locking unit 33. That is, according to one embodiment of the present disclosure, the end of the locking pin 331 protruding outwards through the locking pin insertion hole 32 is inserted into the engagement groove 63 in the ball cover 6, and the pair of engagement projections 34 may be disposed in the pair of guide grooves 111*c* so as to restrict the pivoting movement and/or the tilting movement of the stick 2, thereby maintaining the stick 2 in the upright state with respect to the body 1. Of course, when the stick 2 is forcibly moved, the locking pin 331 moves downwards to release the coupled state between the locking pin and the engagement groove, thereby enabling the pivoting movement and/or the tilting movement of the stick 2.

Figure 7:
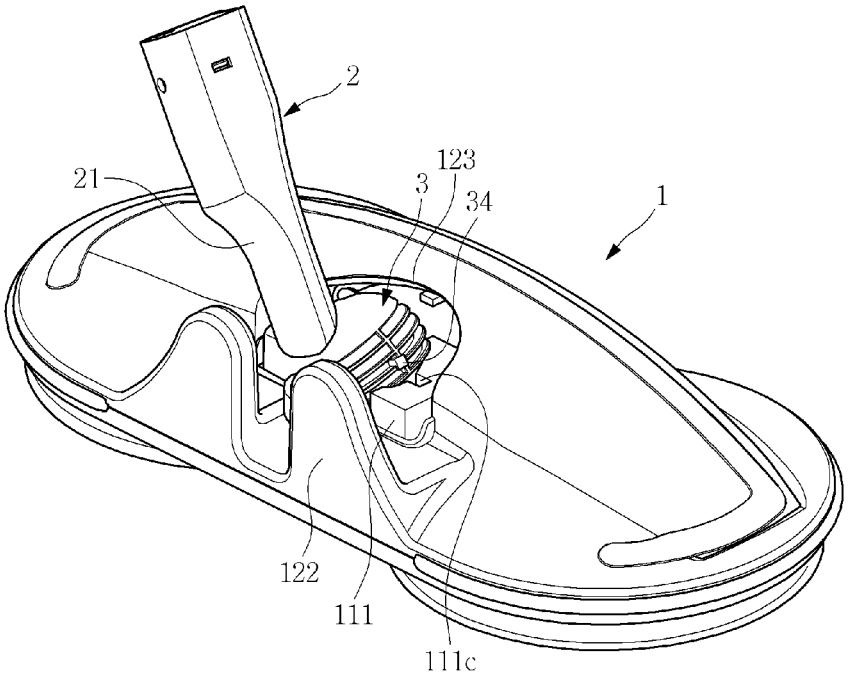
FIG. 7 is a view schematically illustrating a stick, which pivots leftwards in the body of the rotary mop cleaner according to the embodiment of the present disclosure.
Figure 8:
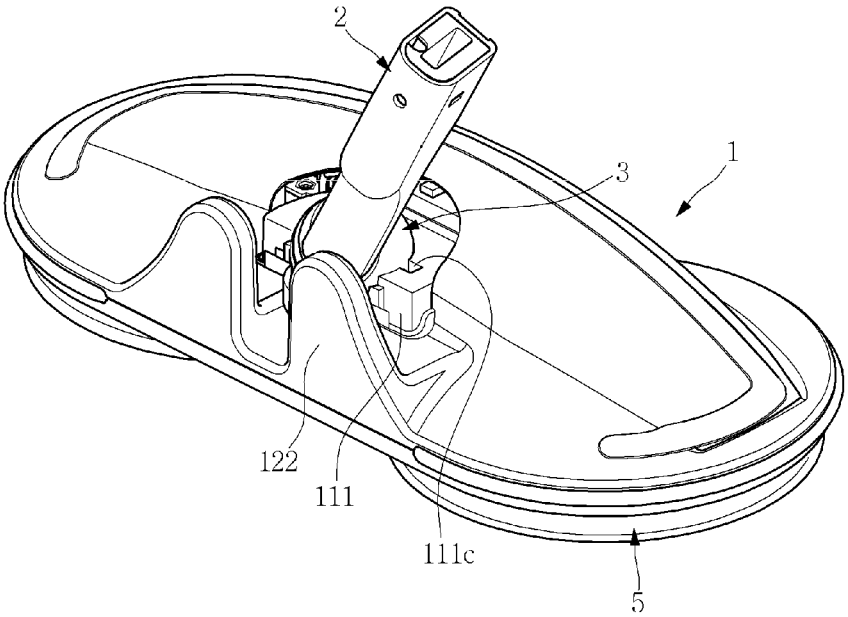
FIG. 8 is a view schematically illustrating the stick, which pivots rightwards in the body of the rotary mop cleaner according to the embodiment of the present disclosure.
Figure 9:
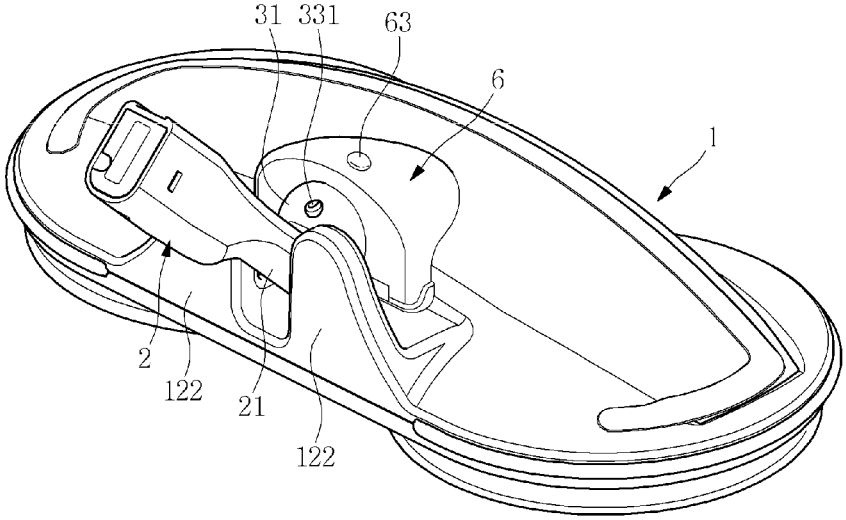
FIG. 9 is a view schematically illustrating the stick, which pivots rearwards in the body of the rotary mop cleaner according to the embodiment of the present disclosure.

The rotary mop cleaner according to the embodiment of the present disclosure is capable not only of maintaining the upright state as illustrated in FIG. 5, but also of guiding the stick to be pivotable rearwards, leftwards, and rightwards as illustrated in FIGS. 7 to 9.

FIG. 7 is a view illustrating a state in which the stick is displaced in the leftward direction in the body of the rotary mop cleaner according to the embodiment of the present disclosure, in which the ball cover 6 is removed in the drawing so that the seating state of the ball joint 3 on the ball support portion 111 can be seen.

When an external force is applied to the stick 2 in the leftward direction in the upright state illustrated in FIG. 5, in the rotary mop cleaner according to the embodiment of the present disclosure, as described above, the locking pin 331 may be separated from the engagement groove 63 of the ball cover, so that the stick 2 can be displaced in the leftward direction. The stick 2 may be tilted leftwards so that even a narrow space can be cleaned by pushing the mop into the narrow space.

At this time, the engagement projection 34 disposed on the right side of the outer peripheral surface of the hollow ball 31 is separated from the guide groove 111*c* provided on the right side of the ball support 111 while the engagement projection 34 (not illustrated in FIG. 7) disposed on the left side of the outer peripheral surface of the hollow ball 31 slides in the guide groove 111*c* (not illustrated in FIG. 7) provided on the left side of the ball support 111. As a result, the reliable pivoting and tilting movements of the stick 2 in the leftward direction can be ensured.

FIG. 8 is a view illustrating a state in which the stick is displaced in the rightward direction in the body of the rotary mop cleaner according to the embodiment of the present disclosure, in which the ball cover 6 is removed in the drawing so that the seating state of the ball joint 3 on the ball support portion 111 can be seen.

When an external force is applied to the stick 2 in the rightward direction in the upright state of FIG. 5, in the rotary mop cleaner according to the embodiment of the present disclosure, as described above, the locking pin 331 may be separated from the engagement groove 63 of the ball cover, so that the stick 2 can be displaced in the rightward direction. The stick 2 may be tilted rightwards so that, even a narrow space can be cleaned by pushing the mop into the narrow space.

At this time, the engagement projection 34 (not illustrated in FIG. 8) disposed on the left side of the outer peripheral surface of the hollow ball 31 is separated from the guide groove 111*c* (not illustrated in FIG. 8) provided on the left side of the ball support 111 while the engagement projection 34 (not illustrated in FIG. 8) disposed on the right side of the outer peripheral surface of the hollow ball 31 slides in the guide groove 111*c* (not illustrated in FIG. 8) provided on the right side of the ball support 111. As a result, the reliable pivoting and tilting movements of the stick 2 in the rightward direction can be ensured.

FIG. 9 is a view illustrating the state in which the stick is displaced rearwards in the body of the rotary mop cleaner according to the embodiment of the present disclosure. The connecting portion 21 of the stick 2 is guided between the pair of the protrusions 122 to pivot the stick 2 rearwards with respect to the body 1, thereby restricting an unnecessary lateral movement of the stick while improving the ability of the body to advance in a straight line so that cleaning can be easily performed.

When a rearward external force is applied to the stick 2 in the upright state illustrated in FIG. 5, in the rotary mop cleaner according to the embodiment of the present disclosure, as described above, the locking pin 331 may be separated from the engagement groove 63 of the ball cover, so that the stick 2 can be displaced rearwards.

Meanwhile, when the stick 2 is made to be displaced forwards from the body 1 of the rotary mop cleaner, it is normal that the forward displacement is not allowed because the ball support 111 and the ball cover 6 cover more than half of the entire spherical surface of the ball joint 3.

However, in the development process before arriving at the present disclosure, when a forward external force is applied to the stick 2 somewhat excessively, the ball joint 3 is separated from the ball support 111, and as a result the stick 2 is completely separated from the body 1 and the parts thereof were broken. One embodiment of the present disclosure may include a structure for effectively suppressing such a dislocation phenomenon.

More specifically, when a forward external force is applied to the handle of the stick 2, the stick 2, more specifically, the front portion of the connecting portion 21 in the stick 2, comes into contact with the outer surface on the rear side of the ball cover 6 (this contact point becomes the fulcrum of a lever), and the ball joint 3 becomes an acting point of the lever. Since the distance between the fulcrum and the acting point is short while the distance between the force point where the force is applied and the fulcrum is relatively very long, the ball support portion 111 and the ball cover 6, which are coupled to each other, may be destroyed and the ball joint 3 may be dislocated rearwards even with a slightly excessive force.

With respect to this problem, according to one embodiment of the present disclosure, the ball joint 3 is provided with the engagement projections 34 and the ball support 111 includes the guide groove 111*c*. When a forward external force is applied to the stick 2, the right engagement projection 34 is restricted in the right guide groove 111*c* and the left engagement projection 34 is restricted in the left guide groove 111*c* such that the rearward movement of the ball joint 3 is rigidly restricted, thereby preventing the rearward dislocation of the ball joint 3. According to one embodiment of the present disclosure, even if the locking projections 34 are formed in the ball joint 3 and the guide groove 111*c* is formed in the ball support 111 as described above, the pivoting movement and the tilting movement of the stick 2 in the rearward direction and in the leftward and rightward directions can be smoothly performed.

Figure 10:
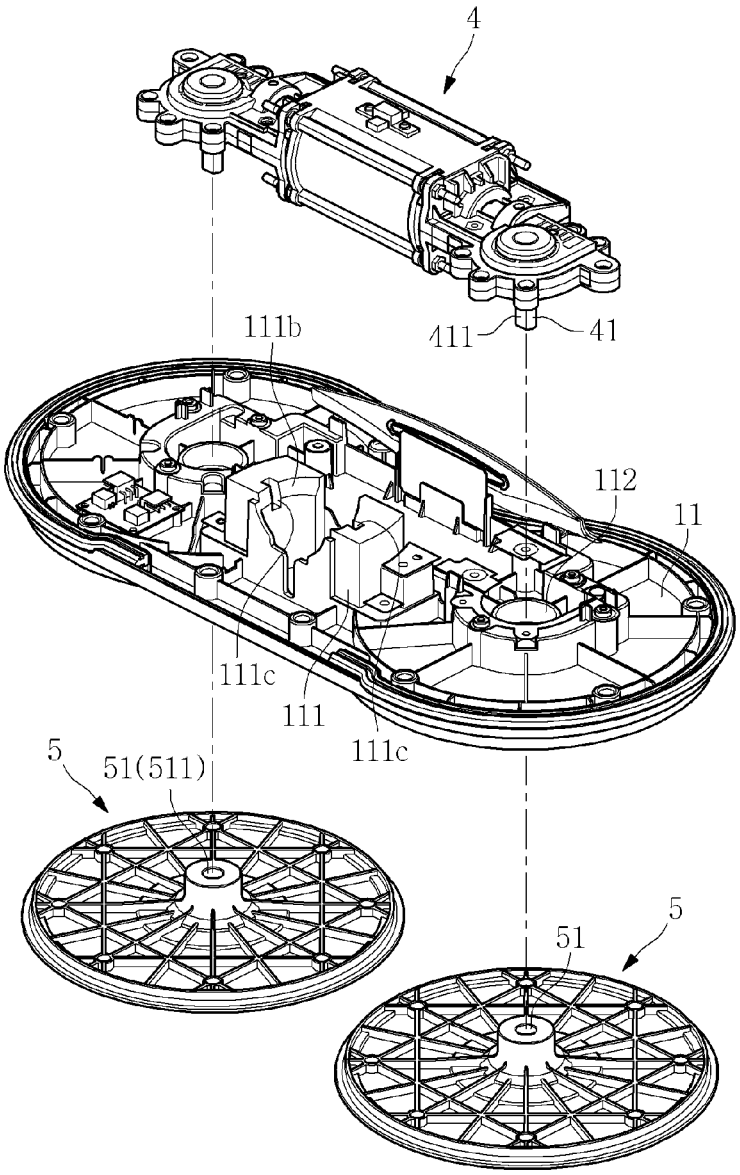
FIG. 10 is an exploded perspective view schematically illustrating a rotary plate drive unit, a base, and rotary plates.
Figure 11:
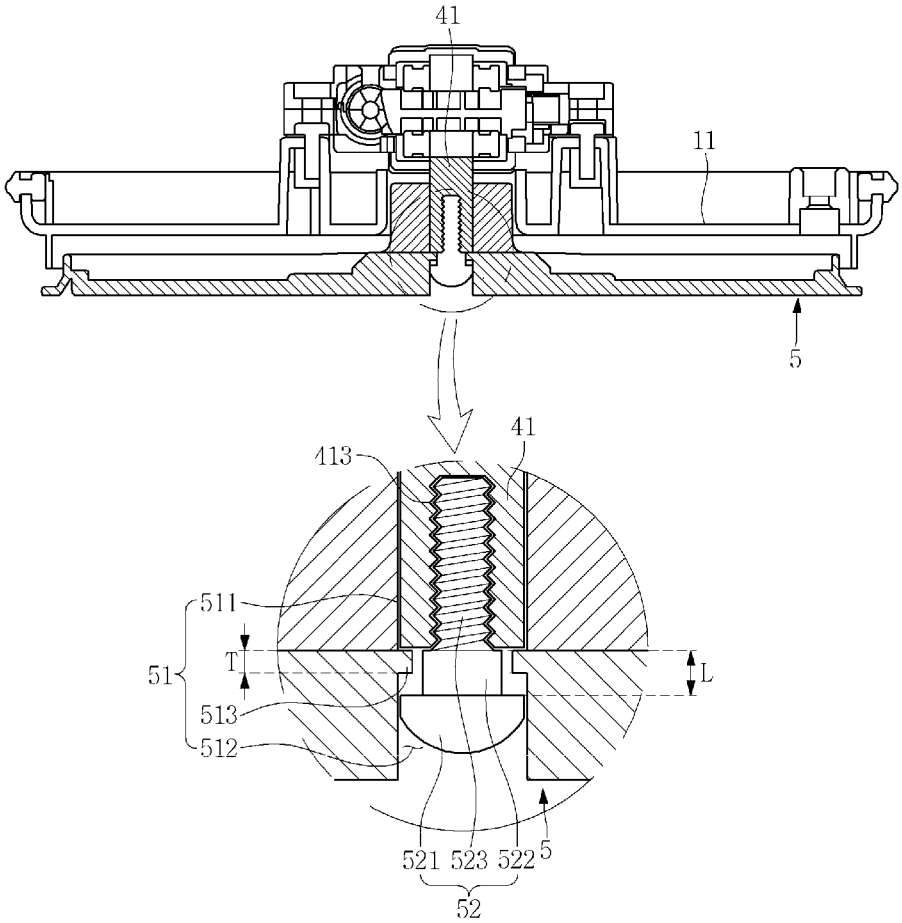
FIG. 11 is a cross-sectional view of the rotary mop cleaner taken along line B-B of FIG. 4.

Referring to FIGS. 10 and 11, in the rotary mop cleaner according to an embodiment of the present disclosure, the ends of the pair of rotary shafts 41 extending downwards from both sides of the rotary plate drive unit 4 may protrude from the lower surface of the base 11. The lower ends of the rotary shafts 41 protruding from the lower surface can be detachably coupled to the rotary plates 5 disposed on the lower surface of the base 11 by, for example, a bolt fastening method. Each rotary plate 5 may be formed in a disc shape as illustrated in the drawings, and a mop (not illustrated) may be easily attached to or detached from the lower surface of the rotary plate by a means such as a Velcro strip. The mop is capable of wiping the floor surface of a living room or an office and rotate by being brought into contact with the floor surface of the living room or the office and rotated. The rotary mop cleaner according to the embodiment of the present disclosure rotates the pair of rotary plates 5 in different directions by the rotary plate drive unit 4 such that a leaning phenomenon, which causes the rotary mop cleaner to proceed in the rotating direction when the pair of rotary plates 5 are rotated in the same direction, can be prevented, and thus the rotary mop cleaner can be used more conveniently.

As illustrated in the drawings, the rotary shafts 41 extend through the through holes 112 in the base 11 and through shaft connecting holes 51 formed at the centers of the rotary plates 5, and each rotary shaft 41 may have a female thread 413 formed in the lower end thereof in the axial direction. Specifically, each shaft connecting hole 51 is provided with an O-ring-shaped engagement step 513 along the inner circumferential surface thereof, and the engagement step 513 may partition the upper connecting hole 511 and the lower connecting hole 512 from each other while allowing communication therebetween.

The upper connecting hole 511 may be a rotary body, that is, a portion that is coupled by inserting the rotary shaft 41 into the rotary plate 5. As illustrated in the drawings, the rotary shaft 41 has an engagement surface 411 on the lower end thereof, and the upper coupling hole 511 is formed in a shape corresponding to the outer shape of the lower end of the rotary shaft to be matched with the lower end of the rotary shaft in order to prevent the rotary shaft from idling. Without being limited thereto, the rotary shaft 41 may be configured to have a key or a polygonal cross section in the lower end, and a key way or a polygonal groove may be formed in the upper connecting hole 511 to correspond to the key or polygonal cross section, so that the rotational force of the rotary shaft can be transmitted to the rotary plate 5.

The lower connecting hole 512 may be disposed coaxially with the upper connecting hole 511 to allow the bolt 52 to enter the lower connecting hole 512 and the upper connecting hole 511.

As described above, according to the embodiment of the present disclosure, the rotary plate 5 may be fixed around the rotary shaft 41 via the bolt 52. The bolt 52 may include a bolt head 521, a bolt shank 522, and a male thread 523. The hole size in the engagement step 513 may be formed to be the same as that of the bolt body 522. Preferably, the hole size of the engagement step may be formed to be larger than the cross-sectional size of the bolt shank. Alternatively, the bolt head 521 may be formed to be larger than the hole size of the engagement step 513 to prevent the rotary plate 5 from escaping therefrom. Particularly, the thickness T of the engagement step 513 may be smaller than the length L of the bolt shank 522.

The bolt 52 can be inserted into the lower connecting hole 512 and rotated in one direction to fasten the male screw thread 523 to the female screw thread 413 in the rotary shaft. Of course, the lower connecting hole 512 may have a depth such that the bolt head 521 does not protrude from the lower surface of the rotary plate 5 when the bolt is fastened.

The engagement step 513 of the rotary plate 5 may be interposed between the lower end of the rotation shaft 41 and the bolt head 521 so that the thickness T of the engagement step 513 is smaller than the length L of the bolt shank 522 so that it is possible to provide a predetermined clearance space in which the rotary plate 5 can be moved in the axial direction (vertical direction). When the rotary plate 5 continuously rotates on a non-flat floor surface of a living room or an office or the like, the rotary plate 5 is rotated in a tilted state under the influence of the degree of unevenness of the floor surface and will transmit substantial vibration to the rotary shaft 41. Thus, according to an embodiment of the present disclosure, the rotary plate 5 may be fastened to have a clearance space with respect to the rotation shaft 41 such that the rotary plate 5 is movable up and down within a predetermined range along the shape of a non-flat floor surface. From this, an effect of reducing noise and vibration of the rotary mop cleaner can be expected, and the durability of the rotary plate drive unit 4 may be improved.

While the present disclosure has been particularly illustrated and described with reference to embodiments thereof, the rotary mop cleaner according to the present disclosure is not limited to the embodiments. It will be apparent that modifications and improvements can be made by those skilled in the art.

All such modifications and variations are intended to be included in the scope of the present disclosure, which will be clarified by the appended claims.

What is claimed is:

1. A rotary mop cleaner comprising:

a ball joint formed at a lower end of a stick, the ball joint including:

a hollow ball;

a locking pin insertion hole formed in an upper end of the hollow ball;

a pair of engagement projections extending outwards from the hollow ball, the pair of engagement projections is disposed on a longitude line that passes through the locking pin insertion hole in the hollow ball, and a straight line connecting the pair of engagement projections is arranged to be orthogonal to a straight line connecting a center of the hollow ball and the locking pin insertion hole;

a locking unit fixedly coupled into an inner space of the hollow ball, the locking unit including a locking nut and a locking pin;

a body including a base provided with a ball support configured to rotatably accommodate the hollow ball, and guide grooves formed to correspond to the pair of engagement projections, the stick is coupled to the body through the ball joint to be capable of performing a pivoting movement and a tilting movement in a rearward direction and in leftward and rightward directions;

a ball cover fastened to the body to cover the ball joint, the ball cover including an engagement groove formed to accommodate an end of the locking pin;

a rotary plate drive unit accommodated in the body and having a rotary shaft passing through a through hole of the base of the body; and a rotary plate comprising a lower surface and a shaft connecting hole in a central portion of the rotary plate for coupling the rotary plate to the rotary shaft of the rotary plate drive unit with a fastener;

the shaft connecting hole extending in an axial direction and comprising:

an upper connecting hole configured to receive and couple to the rotary shaft so that a rotational force of the rotary shaft can be transmitted to the rotary plate;

a lower connecting hole in the lower surface of the rotary plate disposed coaxially with the upper connecting hole and sized to receive the fastener therein;

an engagement step between the upper connecting hole and the lower connecting hole, the engagement step has a thickness in an axial direction and defines an engagement hole that is smaller than each one of the upper connecting hole and the lower connecting hole, the fastener extends through the engagement hole into cooperation with the rotary shaft, a head of the fastener is arranged in the lower connecting hole to define a clearance gap between the head and the rotary shaft when fully tightened; and the thickness of the engagement step is smaller than the clearance gap so that the rotary plate is movable up and down in the axial direction relative to the rotary shaft within a predetermined range when the fastener is fully tightened;

wherein when the stick is in an upright state, an end of the locking pin protrudes from an upper portion of the hollow ball through the locking pin insertion hole so as to be accommodated in the engagement groove formed in an inner side of an upper end of the ball cover.

2. The rotary mop cleaner of claim 1, wherein the ball cover is formed with a clearance groove to expose a connecting portion between the stick and the ball joint.

3. The rotary mop cleaner of claim 1, wherein the rotary plate drive unit is provided with a pair of rotary shafts and the rotary mop cleaner is provided with a pair of rotary plates, which are respectively coupled to lower ends of the pair of rotary shafts of the rotary plate drive unit to be rotated in opposite directions.

4. The rotary mop cleaner of claim 1, wherein the ball support comprises a concave hemispherical accommodation portion configured to accommodate a lower hemisphere of the hollowball, a seating surface formed on an upper portion of the accommodation portion, and a pair of concave guide grooves formed in the accommodation portion.

5. The rotary mop cleaner of claim 4, wherein the seating surface is curved to have a curvature which is equal to a curvature of an outer peripheral surface of the hollow ball.

6. The rotary mop cleaner of claim 1, wherein the locking pin has a spring provided therein, a locking pin fixing portion is configured to support a vertical movement of the locking pin, and a locking unit support is configured to support the locking pin fixing portion and is fastened to the inner space of the hollow ball.

7. The rotary mop cleaner of claim 1, wherein the fastener further comprises a bolt shank, and the engagement step has a thickness smaller than a length L of the bolt shank.

8. The rotary mop cleaner of claim 7, wherein the engagement hole is step has a hole size larger than a size of a cross section of the bolt shank.

9. The rotary mop cleaner of claim 1, wherein the body further comprises a dome-shaped portion and a cover having an opening formed behind the dome-shaped portion.

* * * * *